US009522095B2

(12) United States Patent
Steele

(10) Patent No.: US 9,522,095 B2
(45) Date of Patent: Dec. 20, 2016

(54) DEVICES FOR MOBILIZING THE HIP JOINT CAPSULE AND METHODS OF USING SAME

(71) Applicant: Carl W. Steele, Port Clinton, OH (US)

(72) Inventor: Carl W. Steele, Port Clinton, OH (US)

(73) Assignee: Carl W. Steele, Port Clinton, OH (US)

( * ) Notice: Subject to any disclaimer, the term of this patent is extended or adjusted under 35 U.S.C. 154(b) by 641 days.

(21) Appl. No.: 13/921,048

(22) Filed: Jun. 18, 2013

(65) Prior Publication Data

US 2013/0345605 A1 Dec. 26, 2013

Related U.S. Application Data

(60) Provisional application No. 61/663,327, filed on Jun. 22, 2012.

(51) Int. Cl.
*A61H 1/02* (2006.01)

(52) U.S. Cl.
CPC ..... *A61H 1/0244* (2013.01); *A61H 2001/0248* (2013.01); *A61H 2201/0103* (2013.01); *A61H 2201/0134* (2013.01); *A61H 2201/0157* (2013.01); *A61H 2201/1284* (2013.01); *A61H 2201/1614* (2013.01); *A61H 2201/1628* (2013.01); *A61H 2201/1652* (2013.01); *A61H 2201/5071* (2013.01)

(58) Field of Classification Search
CPC ..... A61H 1/02; A61H 1/0237; A61H 1/0244; A61H 1/0255; A61H 2001/0248; A61H 2201/0103; A61H 2205/088; A61H 2205/108
See application file for complete search history.

(56) References Cited

U.S. PATENT DOCUMENTS 3,831,941 A * 8/1974 Pease ..... A63B 71/0054 267/116
5,236,411 A * 8/1993 Backman ..... A61F 5/3753 128/845
5,242,348 A * 9/1993 Bates ..... A63B 21/0004 482/105
5,483,832 A * 1/1996 Pauser ..... A61B 5/227 600/591
5,494,049 A * 2/1996 Rischbieth ..... A61F 5/34 128/845
5,681,270 A * 10/1997 Klearman ..... A61F 5/0193 128/845

(Continued)

*Primary Examiner* — Justine Yu
*Assistant Examiner* — Michael Tsai
(74) *Attorney, Agent, or Firm* — Rankin, Hill & Clark LLP

(57) ABSTRACT

A method for mobilizing a hip joint capsule of a patient using a resilient bolster. In accordance with the method, the patient assumes a lateral position, with the hip capsule to be treated superior. The resilient bolster is placed between the patient's legs as proximal to the patient's crotch. A force is applied to patient's superior leg to move it downwardly from a resting position. During downward movement of the patient's superior leg, the bolster functions as a fulcrum and the patient's superior femur functions as a lever arm to create a first class lever that partially distracts the femoral head from the acetabulum. After application of the force, the resiliency of the bolster causes the patient's superior leg to return to the resting position. The movements may be repeated, and the degree of hip flexion and rotation may be varied to affect different regions of the hip capsule.

9 Claims, 9 Drawing Sheets

(56) References Cited

U.S. PATENT DOCUMENTS

| | | | | |
|---|---|---|---|---|
| 5,895,366 | A * | 4/1999 | Bzoch | A61F 5/012 128/845 |
| 7,677,249 | B2 * | 3/2010 | Kong | A61G 13/0036 128/845 |
| 7,832,401 | B2 * | 11/2010 | Torrie | A61G 13/0036 128/845 |
| 2002/0106468 | A1 * | 8/2002 | Obeshaw | B21C 37/15 428/36.9 |
| 2004/0133983 | A1 * | 7/2004 | Newkirk | A61G 13/0036 5/624 |
| 2004/0198570 | A1 * | 10/2004 | Tanglos | A63B 23/0488 482/111 |
| 2006/0217248 | A1 * | 9/2006 | Diseati | A63B 21/4013 482/128 |
| 2008/0188360 | A1 * | 8/2008 | Chu | A63B 69/004 482/83 |
| 2011/0218469 | A1 * | 9/2011 | Branch | A61F 5/012 602/13 |
| 2012/0322633 | A1 * | 12/2012 | Holman | A63B 21/028 482/123 |

* cited by examiner

DEVICES FOR MOBILIZING THE HIP JOINT CAPSULE AND METHODS OF USING SAME

BACKGROUND OF INVENTION

Field of Invention

The present invention relates to devices for use in mobilizing a hip joint capsule and methods for mobilizing a hip joint capsule that utilize the same.

Description of Related Art

The acetabulofemoral joint (i.e., the hip joint) is the joint between the femur and the acetabulum of the pelvis. Its primary function is to support the weight of the body in both static (e.g., standing) and dynamic (e.g., walking or running) postures.

The articular capsule of the hip joint is strong and dense. It attaches to the hip bone outside the acetabular lip, which thus projects into the capsular space. On the femoral side, the distance between the head's cartilaginous rim and the capsular attachment at the base of the neck is constant, which leaves a wider extracapsular part of the neck at the back than at the front. The strong but loose fibrous capsule of the hip joint permits the hip joint to have the second largest range of movement (second only to the shoulder) and yet support the weight of the body, arms and head.

Injuries and other conditions can result in a loss of range of motion and strength at the hip joint. A common treatment approach utilized to treat joint restriction and limitations at the hip is joint mobilization. Conventional treatments consist of three types of hip mobilization techniques. The first is long axis distraction of the lower extremity. The second is forced range of motion. And the third is lateral distraction of the hip, which involves positioning the patient supine on a treatment table with the hip to be treated adjacent to the edge of the table. A therapist wraps a belt or band around the patient's leg near the hip to be treated and also around the therapist's leg. While in a lunge position, with the therapist facing the patient, the therapist applies a light distraction force by taking up slack in the belt or band to distract the patient's hip laterally using the belt.

The conventional treatment methods are often uncomfortable for the patient. And forced range of motion often results in increased pain and therefore limited compliance. The long axis technique exposes the knee to extrinsic forces and has little effect on the entire hip capsule. And, the belt technique is extremely labor intensive insofar as the therapist is concerned. It is generally poorly tolerated when adequate force to distract the hip joint is applied. And, force is limited because the patient will slide off the treatment table unless the pelvis is also restrained by a stabilizing strap.

BRIEF SUMMARY OF THE INVENTION

In view of the foregoing, the present invention is directed toward devices for use in mobilizing a hip joint capsule and methods for mobilizing the hip joint capsule that utilize the same. Devices according to the invention comprise a bolster, which in a preferred embodiment comprises a pneumatic bladder. The device can further include a valve for adjusting the air pressure within the bladder and optionally one or more straps, which can be used to maintain the position of the device relative to the user when the device is used in accordance with the inventive methods disclosed herein.

In one embodiment, the bladder comprises an elongate structure having a substantially non-extensible axial core and a flexible membrane that is spaced away from but surrounds the axial core to define an air cavity. In a non-compressed state, the flexible membrane preferably exhibits a generally cylindrical shape. An inner side of the flexible membrane may be secured to the axial core by a tether. The tether inhibits the extent to which the flexible membrane can expand away from the axial core when the device is compressed during use.

In one method of the invention, the patient assumes a lateral position, with the hip capsule to be mobilized superior. A bolster is placed between the patient's legs proximal to patient's crotch (i.e., the bolster is positioned as near the user's crotch as possible, with the longitudinal axis of the device placed approximately transverse to the patient's superior femur). The bolster thus positioned is capable of serving as a partially compressible fulcrum, with the superior femur serving as a lever arm, to create a first class lever that partially distracts the femoral head of the superior hip from the acetabulum. The degree of hip flexion and rotation is preferably varied to affect different regions of the hip capsule. Devices and methods of the invention provide for mobilization, stretching and/or expansion of the hip joint capsule, restoration of normal hip range of motion, restoration of pain free hip motion and a consequent reduction and/or delay of total hip replacements.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
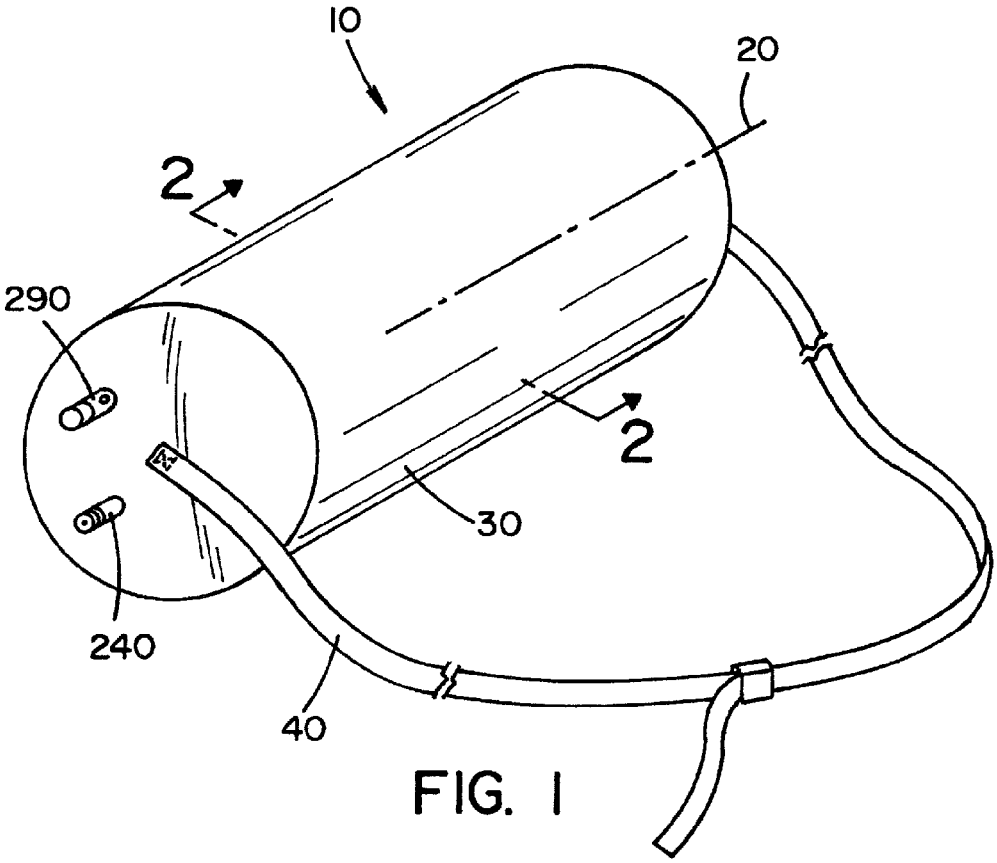
FIG. 1 is a perspective view of an exemplary bolster according to the invention.
Figure 2:
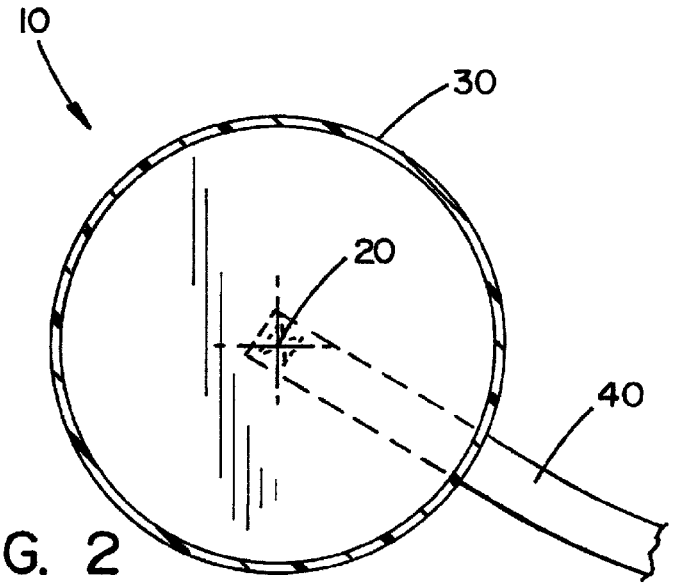
FIG. 2 is a section view taken perpendicular to the longitudinal axis of the bolster shown in FIG. 1 along the line 2-2.

FIG. 1 is a perspective view of an exemplary bolster 10 according to the invention, and FIG. 2 is a section view taken perpendicular to the longitudinal axis 20 of the bolster 10 shown in FIG. 1 along the line 2-2. The bolster 10 is a resilient member, which in accordance with the method of the invention, is disposed between the patient's legs proximal to the patient's crotch such that it supports the weight of the patient's superior leg, in a resting position, in a spaced-apart relationship relative to the patient's inferior leg. The bolster 10 must be a resilient structure such that when a force is applied to the patient's superior leg sufficient to move it downwardly below the resting position with the bolster thus disposed, the bolster partially deforms but also functions as a fulcrum with the patient's superior femur functioning as a first class lever to partially distract the patient's superior femoral head from the patient's superior acetabulum. After the application of the force, the resiliency of the bolster allows the patient's superior leg to move upwardly such that it returns to the resting position.

In the exemplary embodiment illustrated in FIGS. 1 and 2, the bolster 10 comprises a pneumatic bladder 30 and a strap 40, which extends from the bladder 30. The strap 40 is optional, but substantially aids in maintaining the bolster 10 in the proper position during execution of the pressing step of the method of the invention. It will be appreciated that the bolster can be constructed of a variety of shapes and materials provided that it is capable of performing the functions required in the method of the invention.

Figure 3:
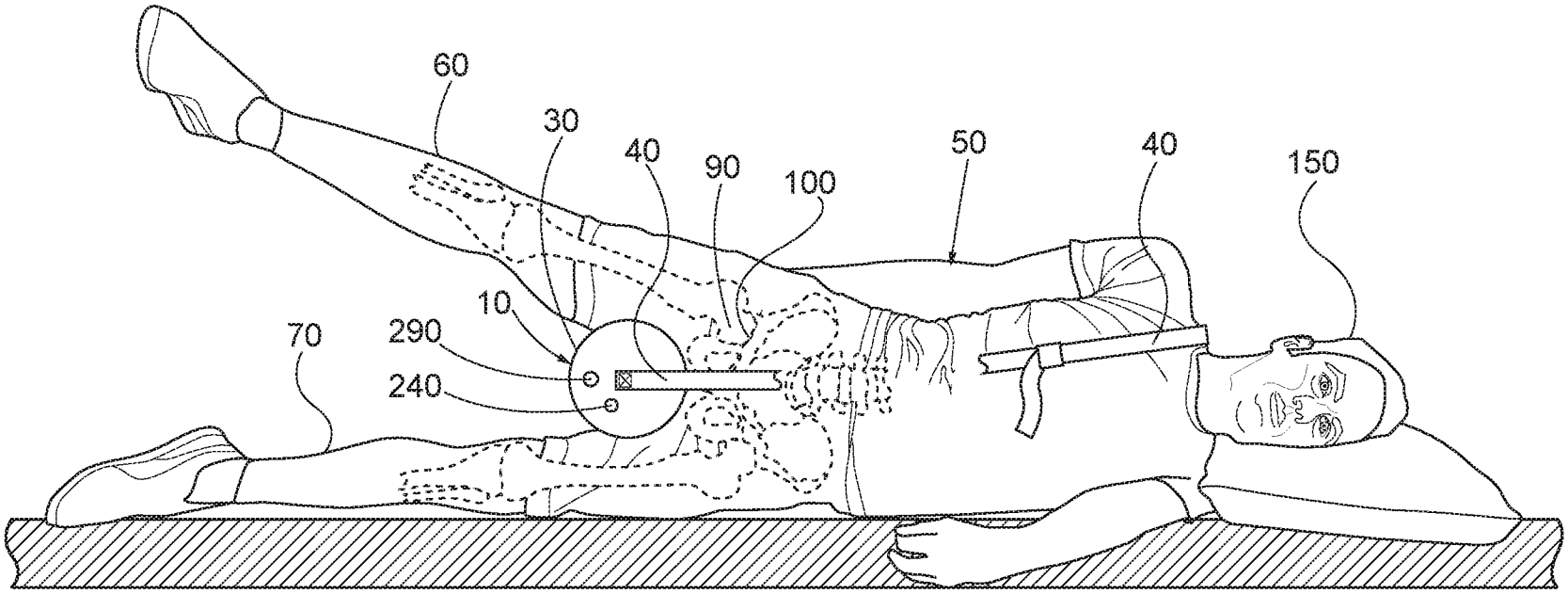
FIG. 3 is a schematic front view of a patient placed in a lateral position with the hip capsule to be mobilized superior, with a resilient bolster disposed between the patient's legs proximal to the patient's crotch such that the patient's superior leg is supported by the bolster in a resting position.
Figure 4:
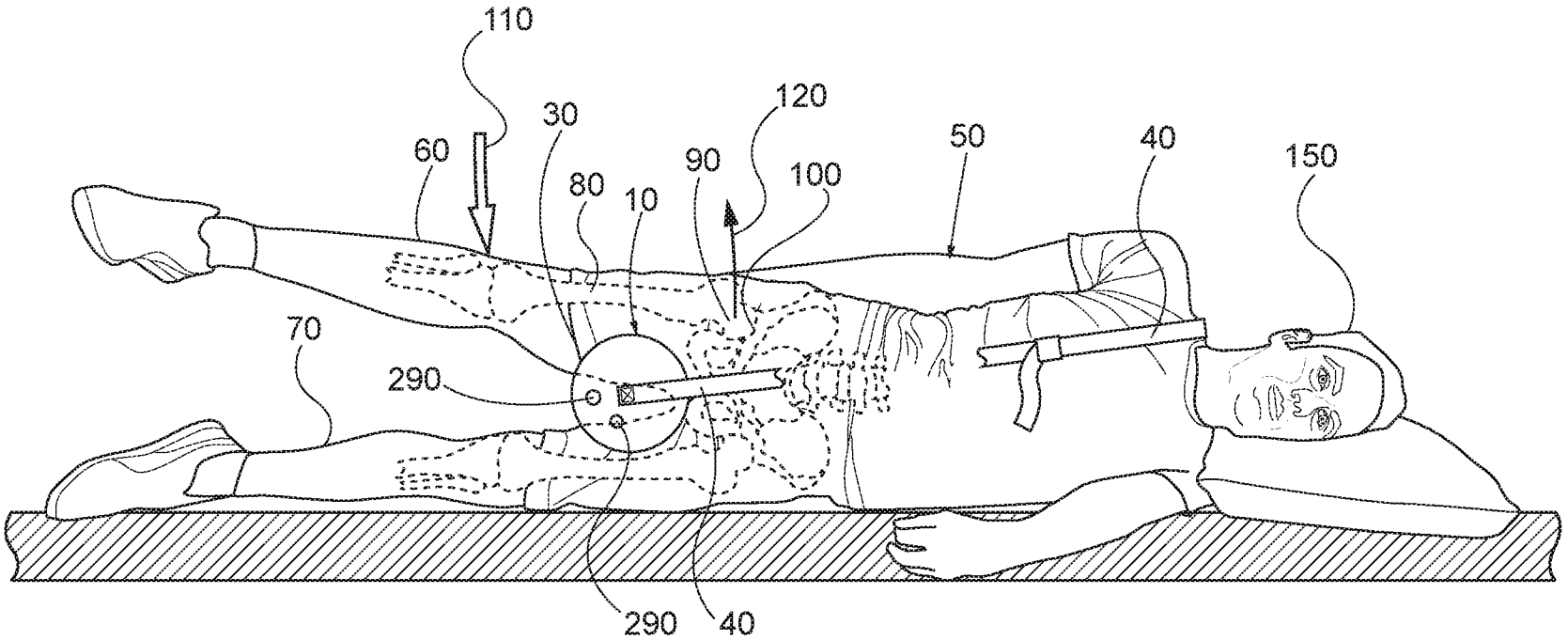
FIG. 4. is a schematic front view of the patient shown in FIG. 3 with the patient's superior leg pressed downwardly from the resting position with the bolster thus disposed.

Steps of the method of the invention are schematically illustrated in FIGS. 3 and 4. In accordance with the method and as illustrated in FIG. 3, a patient 50 is situated in a lateral position with the hip capsule to be mobilized superior and the resilient bolster 10 disposed between the patient's legs 60, 70 proximal to the patient's crotch. Throughout this specification and in the appended claims, the term "patient" denotes a human being upon whom the method is performed, regardless of whether the human being is being treated by a physician or other medical professional. FIG. 3 shows a resting position, in which the patient's superior leg 60 is supported by the bolster 10 (i.e., the bolster 10 supports the weight of the patient's superior leg 60 such that the patient's superior leg 60 is in a spaced-apart relationship with respect to the patient's inferior leg 70). As shown in FIG. 4, a force is applied to the patient's superior leg 60 sufficient to move it downwardly below the resting position with the bolster 10 thus disposed such that the bolster 10 partially deforms but also functions as a fulcrum with the patient's superior femur 80 functioning as a first class lever to partially distract the patient's superior femoral head 90 from the patient's superior acetabulum 100. The direction of the force applied to the patient's superior leg 60 is illustrated in FIG. 4 using 110, and the direction of distraction is illustrated by arrow 120. After application of the force, the patient's superior leg is allowed to move upwardly due to the resiliency of the bolster such that it returns to the resting position.

The use of a resilient bolster allows for displacement of the compression forces applied between the patient's legs over a wide portion of the patient's legs, which reduces or eliminates patient discomfort and prevents injury to and marking of the patient's legs during treatment. The use of a pneumatic bladder is presently believed to be superior to the use of foam pads or other objects, which could cause marking by reason of their inability to rapidly and evenly distribute compression forces over wider areas of contact between the patient's legs. Again, because the bladder is resilient and filled with gas, the amount of surface area in contact with the user's legs expands somewhat as force is applied, thereby redistributing the force equally and evenly throughout the process, making the device comfortable for the patient to use.

The method of the invention is suitable for use on patients that have restricted hip range of motion due to capsular restriction, with or without pain. A properly trained physician should determine whether the patient is a suitable candidate for treatment based upon a patient's history and physical. Patients who have previously had total hip replacement, or who have experienced hypermobility of the hip joint and/or who have primary or metastatic bone disease should not be subjected to treatment in accordance with the method of the invention.

As noted above, the patient should be situated in a lateral position, with the hip capsule to be treated superior. Use of a treatment table is preferred, but the patient can be situated on floor, bed or other suitable flat surface, if necessary. The bolster should be placed between the patient's legs as proximal to the patient's crotch, and thus the patient's hip joint, as possible. As noted above, a strap that extends over the patient's shoulder can be used to aid in maintaining the position of the bolster during the treatment.

In one embodiment of a method of the invention, a treatment provider (e.g., a physician or a therapist) applies a downward force on the epicondylar region of the patient's femur by pressing on the patient's superior leg by hand. The bolster placed between the patient's legs acts as a fulcrum, with the femur acting as a lever arm. The downward force on the femur produces partial distraction at the hip joint. The treatment provider can feel the patient's hip partially distract by placing the hand that is not applying the downward force to the patient's superior leg on the patient's hip joint. The amount of distraction is noticeable, but not extreme.

In an alternative embodiment of a method of the invention, a physician or other properly trained treatment provider trains the patient to perform the treatment at home (i.e., self-treatment). The patient assumes a position as previously described, lying on the side with the hip capsule to be treated superior and with the resilient bolster positioned between the patient's legs proximal to the patient's crotch. The patient abducts the superior leg and then "drops" it (i.e., lets it fall by virtue of the force of gravity), which produces an adduction movement with the center of mass distal to the fulcrum producing partial distraction of the femoral head. It will be appreciated that during the distraction phase of this method, the patient's hip muscles must be relaxed so that the distraction mode is absorbed by the hip capsule rather than by the muscle tissue. This is true whether the patient is self-treating or whether the method is being performed with the assistance of a treatment provider.

Figure 5:
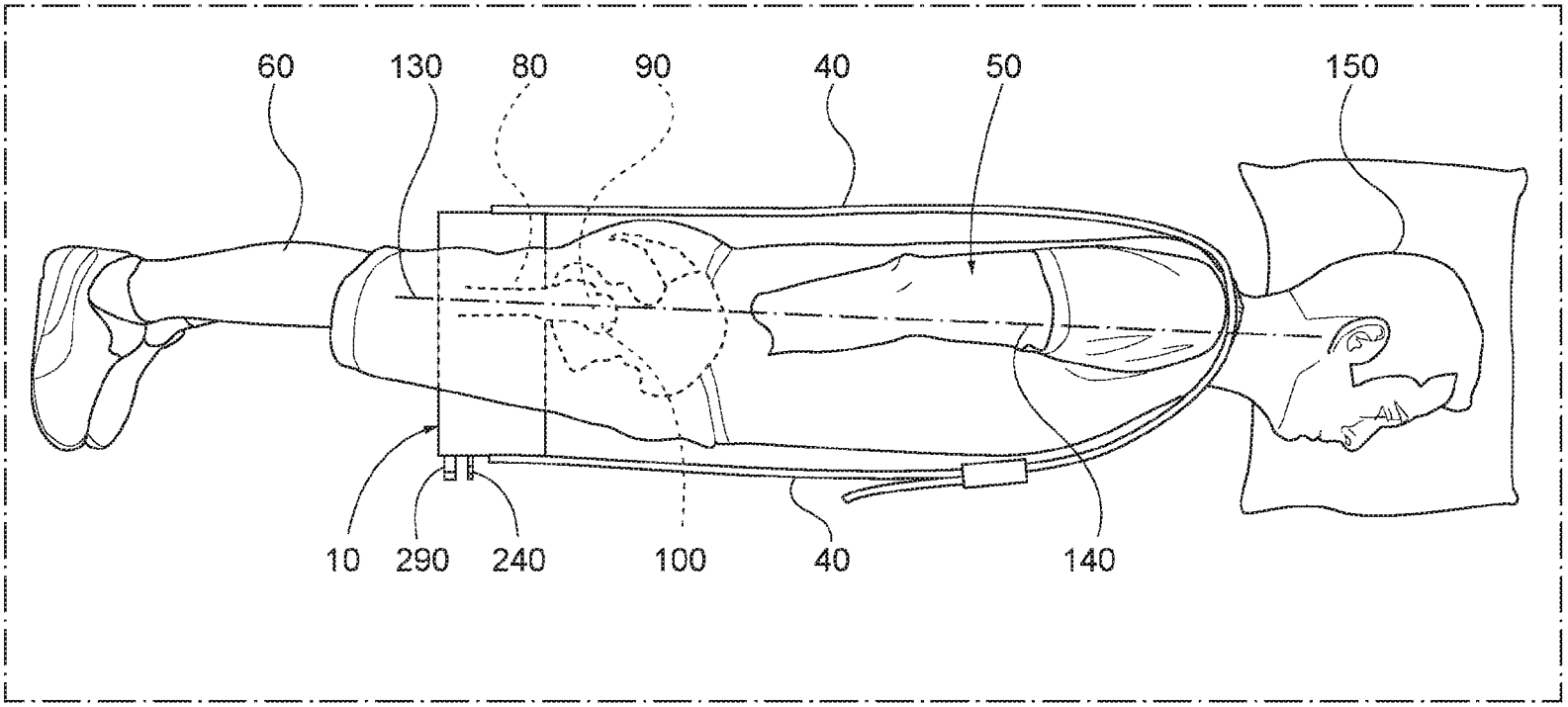
FIG. 5 is a top plan view of a patient placed in a lateral position with the hip capsule to be mobilized superior, with a resilient bolster disposed between the patient's legs proximal to the patient's crotch, with the patient's legs aligned with the patient's torso axis.
Figure 6:
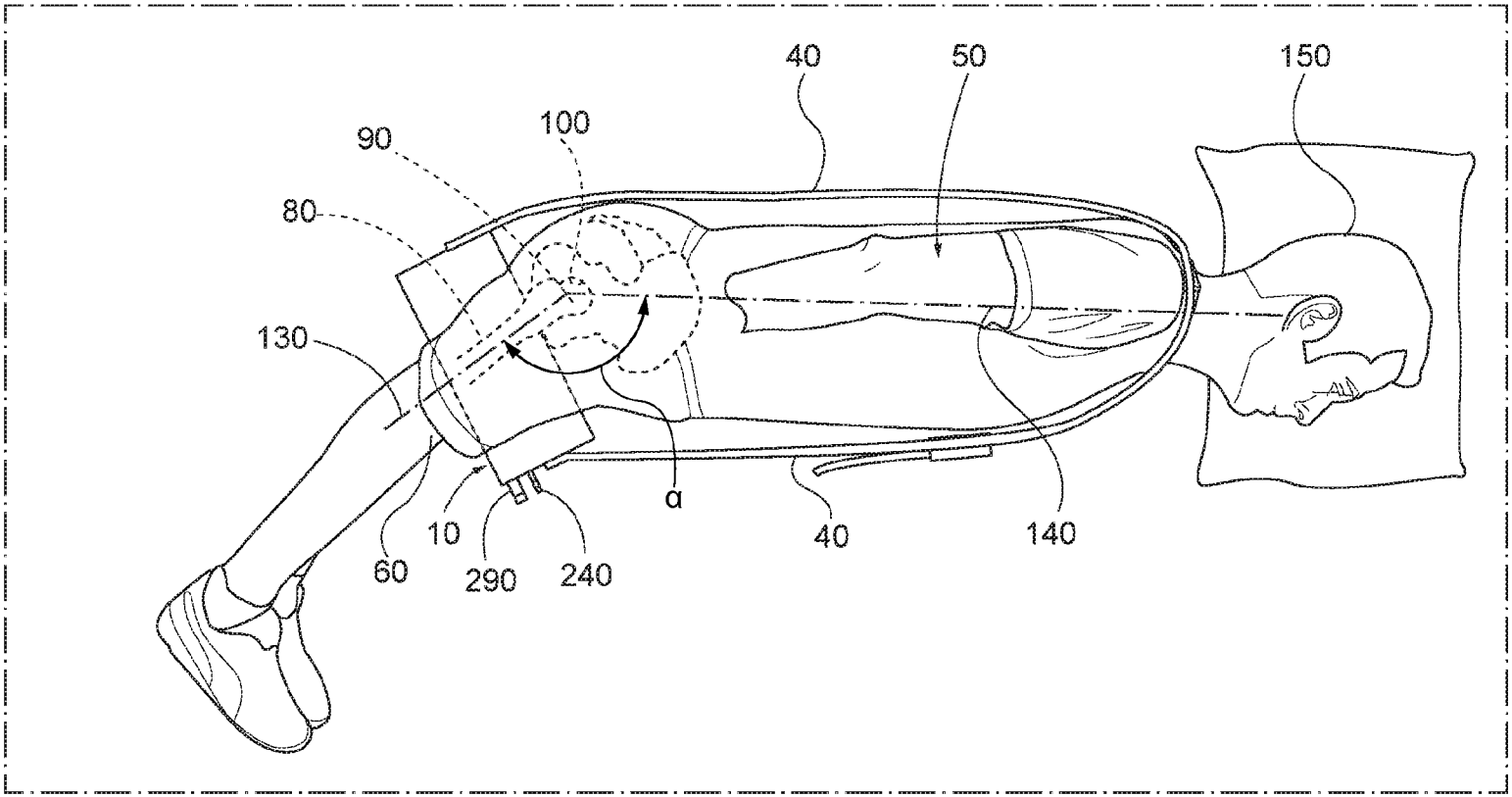
FIG. 6 is a top plan view of the patient shown in FIG. 5, with the patient's legs disposed at an angle $\alpha$ with respect to the patient's torso axis.
Figure 7:
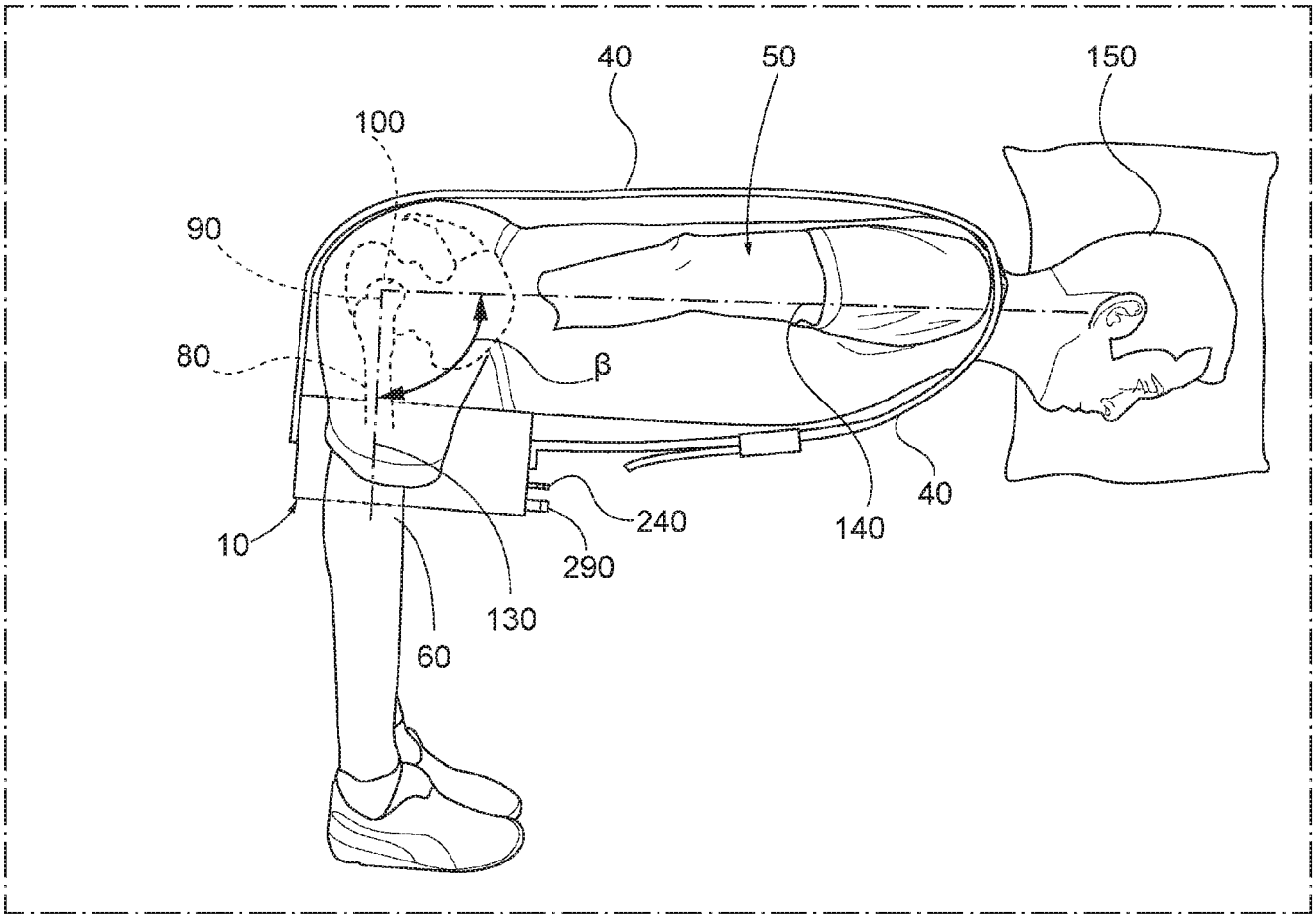
FIG. 7 is a top plan view of the patient shown in FIG. 6, with the patient's legs disposed at an angle $\beta$ with respect to the patient's torso axis.

The degree of hip flexion and rotation is preferably varied during treatment to mobilize different regions of the hip capsule. With reference to FIG. 5, the method can be performed when the longitudinal axis 130 of the patient's superior femur 80 is substantially aligned with a line 140 that bisects the patient's head 150 and superior acetabulum 100. Then, and with reference to FIG. 6, the method can be performed when the longitudinal axis 130 of the patient's superior femur 80 is aligned at an angle α with respect to the line 140 that bisects the patient's head 150 and superior acetabulum 100. It will be appreciated that the method can be performed over a range of superior femur angles including, for example the angle shown in FIG. 7, where the longitudinal axis 130 of the patient's superior femur 80 is aligned at an angle β with respect to the line 140 that bisects the patient's head 150 and superior acetabulum 100. In FIGS. 5-7, the inferior leg is not illustrated. Preferably, the inferior femur would be parallel to the superior femur during the applying step, but the inferior leg is bent at the knee such that the superior leg can pass through a substantial range of motion without contacting the lower inferior leg.

The order in which the method is performed at the various angles is not per se critical. However, applicant typically performs the method as depicted in FIG. 5 (i.e., the longitudinal axis of the patient's superior femur is substantially aligned with a line that bisects the patient's head and superior acetabulum). Then, the method is performed when the patient's superior femur is aligned at an angle α with respect to the line that bisects the patient's head and superior acetabulum, wherein the angle α is greater than 90° but less than 180°. And then the method is performed when the longitudinal axis of the patient's superior femur is aligned at an angle β with respect to the line that bisects the patient's head and superior acetabulum, wherein the angle β is less than the angle α but not less than about 70°.

The amount of force applied to the patient's superior leg is sufficient to partially distract the superior femoral head from the patient's superior acetabulum. Preferably, the extremity is abducted to allow the proximal positioning of the device, and then adducted until the knee approximates the plane of the table or a maximum force approximating 50 pounds is obtained. Force can be applied and released rapidly. For example, the applying step can be completed in one second or less and then be immediately followed by the allowing step. Force can be reapplied quickly, so that the superior leg appears to "bounce" or "rock" as it hinges on the resilient bolster. Force can also be applied at a slower pace, if desired. For example the applying and allowing steps can be repeated sequentially (i.e., a cycle) at least three times within a period of thirty seconds. Cycles of 10 repetitions at multiple angles and rotations are typically performed, provided the treatment remains pain free.

Preferably, both of the patient's hip capsules are mobilized in accordance with the method during a single treatment session. More preferably, both of the patient's hip capsules are mobilized in accordance with the method in three or more consecutive treatment sessions conducted within a month. Applicant has found that lower back pain, particularly lower back pain at or proximal to the sacrum, can be substantially alleviated by performing the method on both hip capsules. It is hypothesized that the lever action applied to the superior femur not only partially distracts the superior femoral head from the patient's superior acetabulum, but also pulls and realigns soft tissues associated with the spine in the sacral region, which leads to low back pain relief.

The method of the invention can be utilized to restore normal hip range of motion over time (e.g., over a period of weeks). By application of force sufficient to cause lateral distraction of the hip, compression loading on the articular surfaces can be reduced. In order to restore normal hip function, the articular surfaces of the hip must glide, slide and rotate in a relatively tension-free environment. If the hip capsule remains short, excessive compression is applied to the femoral head resulting in failure of glide, slide and rotation. Compression loads are magnified due to the lever arm of the femur during normal movement (but not during the movements of the method). The method thus alleviates this compression loading. The method often results in pain free hip motion, and can substantially reduce abnormal compression loading on the articular surfaces, which can delay or possibly reduce the number of total hip replacements and increase patient level of comfort and functional status.

Applicant has 25 years of clinical experience using conventional methods for hip capsule mobilization. The conventional methods are often uncomfortable for the patient and forced range of motion can cause increased pain and limited patient compliance. The method of the invention, when performed as described, is very comfortable. Patients subjected to the treatment in experimental testing stated that it felt comfortable to perform. Results achieved in one treatment session have exceeded results that cannot be obtained in similar patients through six weeks of conventional treatment. The method is relatively easy to perform by the treatment provider because the force of gravity is used to assist the desired motion.

Figure 8:
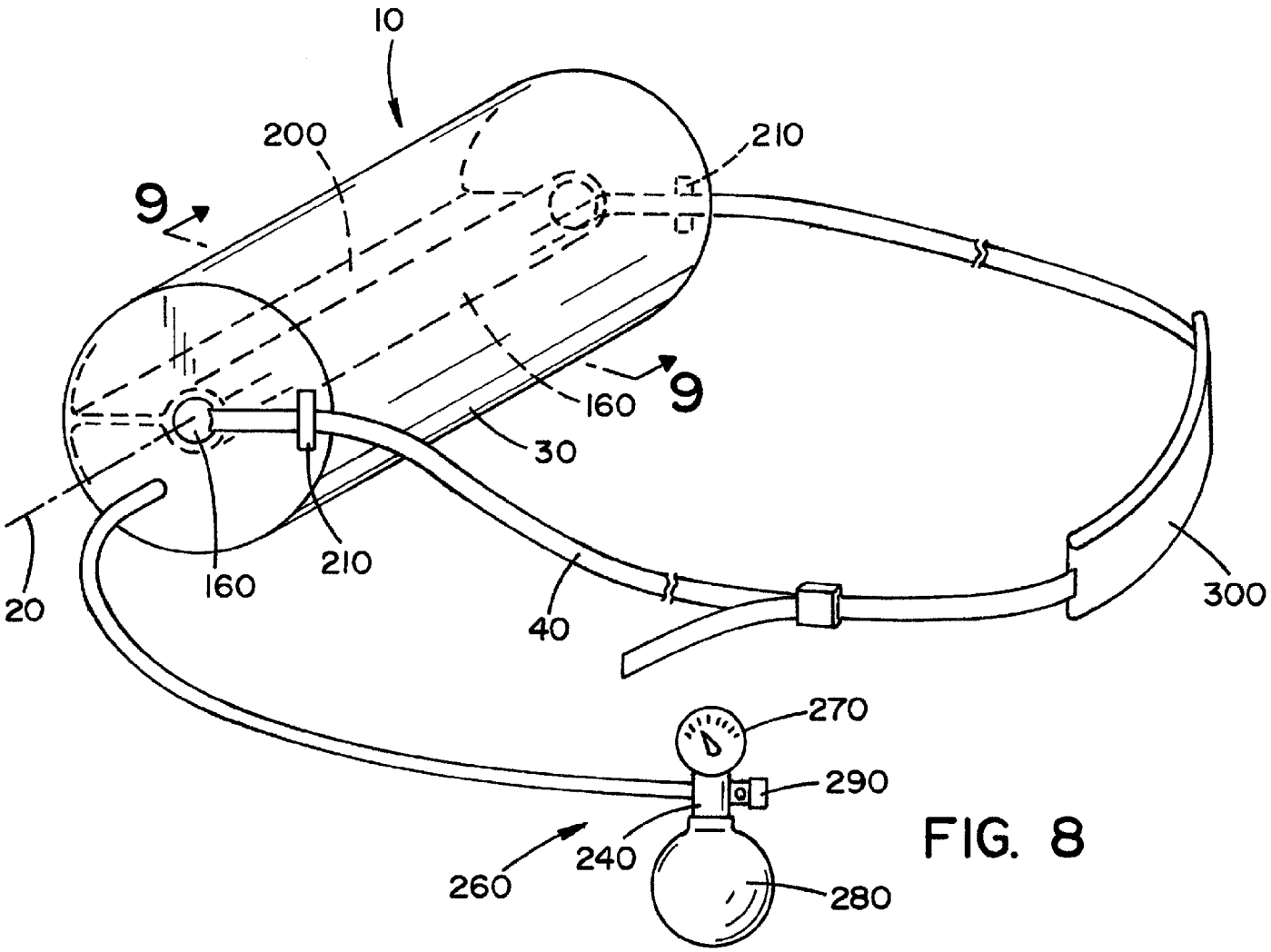
FIG. 8 is a perspective view showing a preferred embodiment of a bolster according to the invention.
Figure 9:
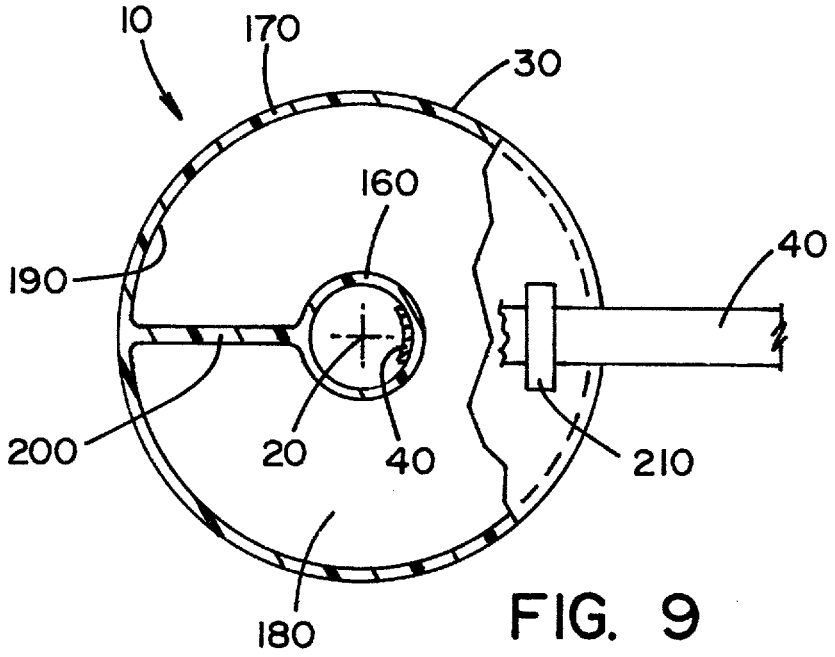
FIG. 9 is partial section view taken perpendicular to the longitudinal axis of the bolster shown in FIG. 8 along the line 9-9.

FIG. 8 shows a preferred embodiment of a resilient bolster 10 according to the invention. The bolster 10 includes a pneumatic bladder 30 comprising an elongate structure having a longitudinal axis 20 and a substantially non-extensible axial core and a flexible membrane 170 that is spaced away from but surrounds the axial core to define an air cavity 180. In a non-compressed state as shown in FIG. 9, the flexible membrane 170 preferably exhibits a generally cylindrical shape (i.e., circular in cross-section transverse to the axial core). In the presently most preferred embodiment of the invention, an inner side 190 of the flexible membrane 170 is secured to the axial core 160 by a tether 200. The tether 200 inhibits the extent to which the flexible membrane 170 can be displaced from (i.e., can expand away from) the axial core 160 when the device 10 is subjected to compression between the user's legs during use (see FIGS. 4 and 10).

Figure 10:
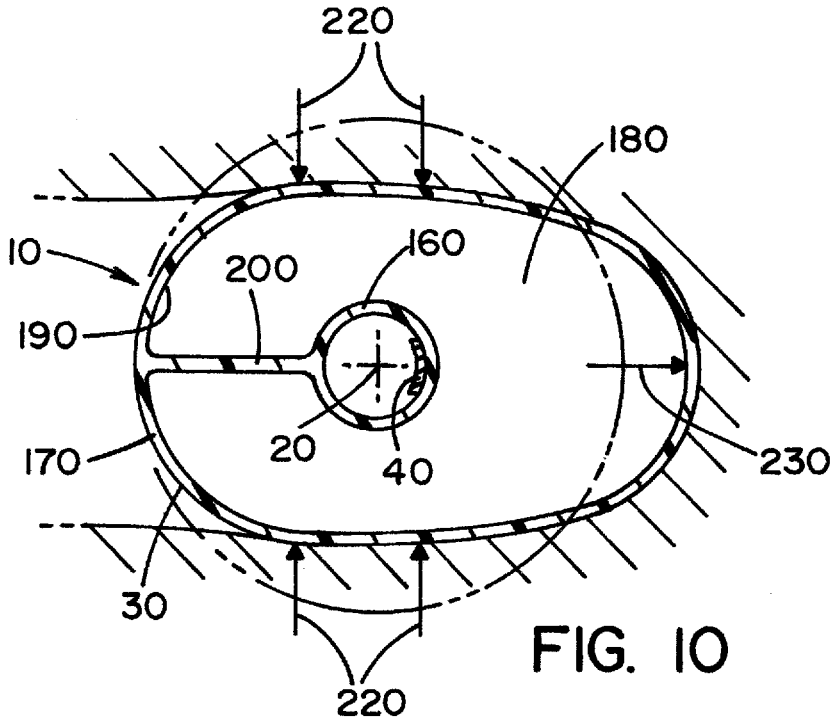
FIG. 10 is a section view of the bolster shown in FIG. 9 under compression during the pressing step of the method of the invention.

The tether 200 as illustrated in FIGS. 8-10 can be configured as a substantially planar sheet, which connects to both the axial core 160 and the inner side 190 of the flexible membrane 170 axially along one side of the axial core 160. Alternative configurations of the tether 200 are contemplated (e.g., a perforated substantially planar sheet, separate and discrete spaced apart structures that extend axially along one side of the axial core 160 to the inner side 190 of the flexible membrane 170).

The bolster 10 can further comprise an orienting anchor 210, which may optionally cooperate with the strap 40 to orient the location of the tether 200 during use. The side of the bolster 10 that includes the tether 200 should be oriented away from the user's crotch. Thus, when the bolster is compressed between the patient's legs illustrated in FIG. 10 by arrows 220, any increase in the lateral dimensions of the bolster 10 caused by such compression is generated toward the user's crotch (i.e., in the direction indicated by arrow 230), which increases the effectiveness of the bolster 10 as a fulcrum. The axial core 160 also serves to prevent flexion or elongation of the bolster 10 during compression.

The flexible membrane is preferably formed of a resilient and compliant polymeric material that can retain a pressurized gas (e.g., air). Suitable materials include vinyl and rubberized materials, which are preferably hypo-allergenic. The bladder preferably includes a valve 240 (see FIG. 1), which can be used to inflate the bladder and adjust the air pressure within the bladder. In a preferred embodiment of the invention, the flexible membrane, when not compressed, defines a generally cylindrical shaped article having a length of about 20 inches, a diameter of about 8 inches and a circumference of about 25 inches.

At a pressure of 2.5 psi, a portion of a flexible membrane having an area of about 100 square inches (e.g., a panel having dimensions of about 10"×10") will support 250 pounds. This amount of pressure is generally sufficient to place approximately 200 pounds of distraction force into a patient's hip in accordance with the present method. Pressure increases in the bladder as the patient's leg is brought downwardly onto the bladder.

It will be appreciated that other shapes and sizes of bladders can be utilized in the method of the invention, particularly in view of the dimensions of the patient being treated. Preferably, when in the resting position, the bolster will have a width measured between the patient's legs within the range of from about 4.0 inches to about 12.0 inches, and will be so constructed that the width of the bolster will not decrease by more than 50% during the application of force. Furthermore, the bolster must be sufficiently resilient that the superior leg will return to the resting position. It will be appreciated that the resting position after the force application step may be lower than before force is applied in the first instance. This is due, in part, to the mobilization of the patient's hip and also in part to minor movements of the bolster during the force application step. Preferably, the patient's superior leg will return to the resting position such that the space between the patient's legs is 90% or more of the initial spacing.

Figure 11:
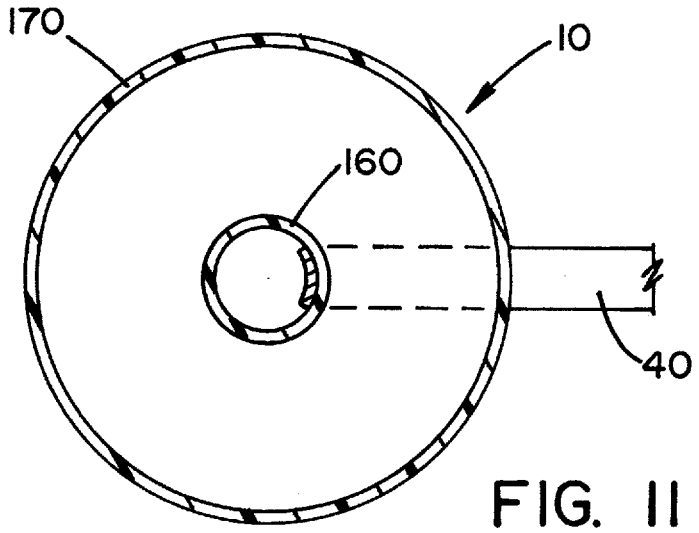
FIG. 11 is a section view of an alternative bolster according to the invention.
Figure 12:
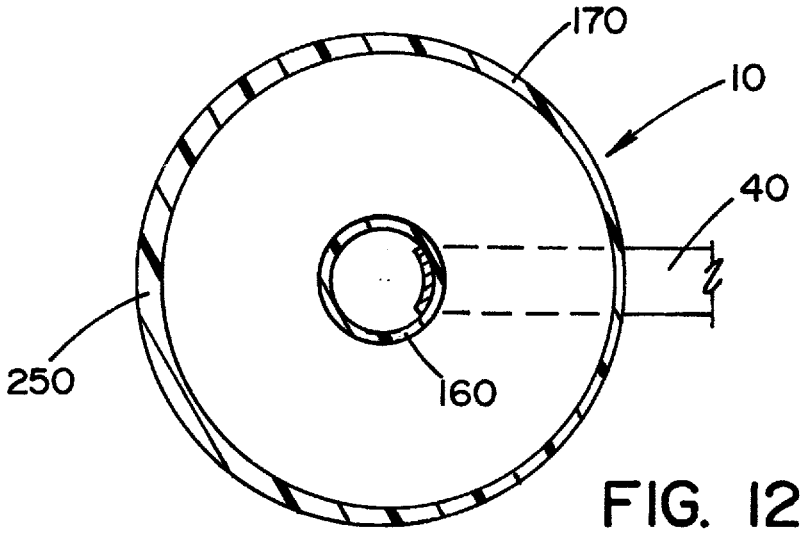
FIG. 12 is a section view of yet another alternative bolster according to the invention.

It will be appreciated that the material properties of the bolster will affect the extent to which it the membrane is capable of flexion under compression. Furthermore, the properties of the bolster can be controlled by varying the thickness of the membrane, for example. With reference to FIG. 11, the thickness of the membrane can be constant or, with reference to FIG. 12, the thickness of the membrane can be increased in the region 250 opposite the direction of the strap 40, which also tends to inhibit distortion (swelling) and displacement of the bolster on the thicker side during compression.

To obtain and maintain an appropriate pressure within the bladder, a valve 240 can be formed in the flexible membrane, such as illustrated in FIG. 1. Alternatively, and with reference to FIG. 8, the bolster 10 can comprise an assembly 260 comprising any one or a combination of a valve 240, pressure gauge 270 and pump 280. The valve 240 can be a rapid pressure relief valve, which ensures that pressure in the bladder is released before damage can occur to the patient's hip and/or the hip capsule. Alternatively, a separate pressure relief valve 290 can be installed (see FIG. 1). The pressure gauge 270 can indicate and/or record the maximum pressure attained during use, and can visually confirm that sufficient force is being applied to obtain partial distraction of the femoral head of the hip from the hip socket, as desired. The pump 280 can be utilized to re-inflate the bladder in the event that insufficient air pressure is present for use.

The strap(s) 40 preferably extend from the ends of from the bolster 10 and thus allow the patient to pull and retain the bolster as proximal to the hip joint as possible and to retain the bolster in such position during treatment. In the illustrated embodiments, a single strap 40 extends from one end of the bolster to the other. A pad 300 can be disposed on the strap 40 to provide a comfortable bearing surface for the patient (e.g., against the patient's shoulder). The patient would place his or her leg through an opening defined by the strap and the bladder, which would allow the patient to retain the bladder between the patient's legs during treatment by pulling on the strap. In an alternative embodiment (not illustrated), the bladder has a separate strap at each end, and the patient would pull on each strap to maintain proper positioning of the bladder during treatment.

It will be appreciated that the superior knee is elevated during performance of the method of the invention. For patients that have knee problems or pain, elevation of the knee can present a source of discomfort. To alleviate such pain and to isolate the hip socket, it is possible to place the knee joint into a rigid brace (not illustrated) that surrounds the leg above and below the knee before the method is performed. The brace prevents flexing of the knee joint during the method, and provides a surface against which a practitioner can press. Thus, the patient's superior knee is protected against bending moments during the force application step.

It will be appreciated that the bolster 10 need not be a freely movable structure. For example, it could be affixed or anchored in a suitable manner proximal to a surgical table to facilitate at least partial hip distraction during surgical procedures. For example, an air filled "wheel" could be used to protect the perineum from injury and or to create lateral distraction on the hip during arthroscopic hip surgery. It is believed that use of a device during surgical procedures could reduce or eliminate complications of arthroscopic hip surgery, including decreasing the risk of injury and possibly improving lateral distraction.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A method for mobilizing a hip capsule of a patient, the method comprising:

placing the patient in a lateral position with the hip capsule to be mobilized superior;

disposing a resilient bolster between the patient's legs proximal to the patient's crotch such that the bolster supports the weight of the patient's superior leg, in a resting position, in a spaced-apart relationship relative to the patient's inferior leg;

applying a force to the patient's superior leg sufficient to move the patient's superior leg from the resting position with the bolster thus disposed such that the bolster partially deforms but also functions as a fulcrum with the patient's superior femur functioning as a first class lever to partially distract the patient's superior femoral head from the patient's superior acetabulum and thereby stretch and expand the patient's hip capsule;

releasing the force applied to the patient's superior leg within two seconds of application of the force thereby allowing the superior leg to return to the resting position; and repeating the applying and releasing steps sequentially at least three times within a period of thirty seconds;

wherein the bolster is an elongate pneumatic bladder, wherein the pneumatic bladder comprises an elongate axial core, a flexible membrane that surrounds the axial core, and an air cavity between the flexible membrane and the axial core, wherein one or more tethers extend between the axial core and the flexible membrane, and wherein, during compression of the pneumatic bladder in the applying step, the one or more tethers inhibit displacement of the flexible membrane away from the axial core along its entire length on one side of the bolster.

2. The method according to claim 1, wherein the bolster has a longitudinal axis that is aligned transverse to both the patient's superior femur and the patient's inferior femur during the applying step.

3. The method according to claim 1, wherein a longitudinal axis of the patient's superior femur is substantially aligned with a line that bisects the patient's head and superior acetabulum during the applying and releasing steps.

4. The method according to claim 3, wherein the applying and releasing steps are repeated when the longitudinal axis of the patient's superior femur is aligned at an angle $\alpha$ with respect to the line that bisects the patient's head and superior acetabulum, said angle $\alpha$ being greater than 90° but less than 180°.

5. The method according to claim 4, wherein the applying and releasing steps are repeated when the longitudinal axis of the patient's superior femur is aligned at an angle $\beta$ with respect to the line that bisects the patient's head and superior acetabulum, said angle $\beta$ being less than said angle $\alpha$ but not less than 70°.

6. The method according to claim 1, wherein the patient's hip capsule is mobilized in at least two treatment sessions.

7. The method according to claim 1, wherein in the resting position, the bolster has a width measured between the patient's legs within the range of from 4.0 inches to 12.0 inches.

8. The method according to claim 1, wherein the flexible membrane defines a cylindrical shape in a non-compressed state prior to the disposing step.

9. The method according to claim 1, wherein the patient's superior knee is protected against bending moments during the applying step.

* * * * *